US009903218B2

(12) United States Patent
Hafner et al.

(10) Patent No.: US 9,903,218 B2
(45) Date of Patent: Feb. 27, 2018

(54) TURBINE SHROUD ASSEMBLY

(71) Applicant: GENERAL ELECTRIC COMPANY, Schenectady, NY (US)

(72) Inventors: Matthew Troy Hafner, Honea Path, SC (US); Victor John Morgan, Simpsonville, SC (US); Frederic Woodrow Roberts, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 303 days.

(21) Appl. No.: 14/827,698

(22) Filed: Aug. 17, 2015

(65) Prior Publication Data

US 2017/0051627 A1 Feb. 23, 2017

(51) Int. Cl.
*F01D 11/22* (2006.01)
*F01D 25/04* (2006.01)
(Continued)

(52) U.S. Cl.
CPC ..... *F01D 11/22* (2013.01); *F01D 11/20* (2013.01); *F01D 25/005* (2013.01); *F01D 25/04* (2013.01);
(Continued)

(58) Field of Classification Search
CPC ..... F01D 11/22; F01D 25/005; F01D 25/04; F01D 25/28; F01D 11/16; F01D 11/14;
(Continued)

(56) References Cited

U.S. PATENT DOCUMENTS 4,334,822 A 6/1982 Rossmann
5,056,988 A * 10/1991 Corsmeier ..... F01D 11/22 415/126
(Continued)

FOREIGN PATENT DOCUMENTS

EP 1 529 926 A2 5/2005
GB 869908 A 6/1961
(Continued)

OTHER PUBLICATIONS

Chupp, Raymond et al.; NASA/TM—2006-214341; Sealing in Turbomachinery, Aug. 2006.*
(Continued)

*Primary Examiner* — Woody Lee, Jr.
*Assistant Examiner* — Sang K Kim
(74) *Attorney, Agent, or Firm* — McNees Wallace & Nurick LLC

(57) ABSTRACT

A turbine shroud assembly is disclosed including an inner shroud having a surface adjacent to a hot gas path, an outer shroud, a damper block disposed between the inner shroud and the outer shroud, a first biasing apparatus, and a second biasing apparatus. The first biasing apparatus provides a first biasing force to the inner shroud, biasing the inner shroud a first deflection distance in a direction toward the hot gas path and away from the outer shroud. The second biasing apparatus provides a second biasing force to the damper block, biasing the damper block a second deflection distance in a direction toward the hot gas path and away from the outer shroud. The second deflection distance is greater than the first deflection distance.

22 Claims, 5 Drawing Sheets

(51) Int. Cl.

| | |
|---|---|
| ***F01D 25/00*** | (2006.01) |
| ***F01D 25/08*** | (2006.01) |
| ***F01D 11/20*** | (2006.01) |
| *F01D 11/14* | (2006.01) |

(52) U.S. Cl.
CPC ..... *F01D 25/08* (2013.01); *F01D 11/14* (2013.01); *F05D 2220/32* (2013.01); *F05D 2240/11* (2013.01); *F05D 2260/52* (2013.01); *F05D 2260/96* (2013.01); *F05D 2300/17* (2013.01); *F05D 2300/171* (2013.01); *F05D 2300/502* (2013.01); *F05D 2300/6033* (2013.01)

(58) Field of Classification Search
CPC ..... F01D 11/20; F01D 25/24; F05D 2220/32; F05D 2220/40; F04D 29/284
USPC ..... 415/173.2
See application file for complete search history.

(56) References Cited

U.S. PATENT DOCUMENTS

| | | | | |
|---|---|---|---|---|
| 6,000,227 | A | 12/1999 | Kroeker | |
| 6,113,349 | A | 9/2000 | Bagepalli et al. | |
| 6,217,279 | B1 | 4/2001 | Ai et al. | |
| 6,315,519 | B1 | 11/2001 | Bagepalli et al. | |
| 6,502,823 | B1 | 1/2003 | Turnquist et al. | |
| 6,758,653 | B2 | 7/2004 | Morrison | |
| 6,786,487 | B2 * | 9/2004 | Dinc | F01D 11/025 277/355 |
| 6,942,203 | B2 * | 9/2005 | Schroder | F01D 9/04 267/160 |
| 7,044,709 | B2 | 5/2006 | Bruce et al. | |
| 7,278,820 | B2 | 10/2007 | Keller | |
| 7,448,849 | B1 | 11/2008 | Webster et al. | |
| 7,563,071 | B2 | 7/2009 | Campbell et al. | |
| 8,047,773 | B2 * | 11/2011 | Bruce | F01D 25/04 415/173.3 |
| 8,555,477 | B2 | 10/2013 | Bates | |
| 8,998,565 | B2 | 4/2015 | Foster et al. | |
| 2009/0202340 | A1 | 8/2009 | Ballard, Jr. | |
| 2013/0177384 | A1 | 7/2013 | Coign et al. | |
| 2016/0376907 | A1 * | 12/2016 | O'Leary | F01D 11/12 415/173.3 |

FOREIGN PATENT DOCUMENTS

| | | | |
|---|---|---|---|
| GB | 2099515 | A | 12/1982 |
| WO | 2014186004 | A2 | 11/2014 |

OTHER PUBLICATIONS

Combined Search and Examination Report issued in connection with corresponding GB Application No. 613989.1 dated Dec. 22, 2016.

* cited by examiner

TURBINE SHROUD ASSEMBLY

FIELD OF THE INVENTION

The present invention is directed to turbine components. More particularly, the present invention is directed to turbine components having an inner shroud loaded to an outer shroud.

BACKGROUND OF THE INVENTION

In gas turbines, certain components, such as the shroud surrounding the rotating components in the hot gas path of the combustor, are subjected to extreme temperatures, chemical environments and physical conditions. Inner shrouds are subjected to further mechanical stresses from pressures applied to load the inner shroud to the outer shroud, pushing against the pressure of the hot gas path. Pressurizing the space between the inner shroud and the outer shroud leaks high pressure fluid into the hot gas path, decreasing efficiency of the turbine. Further, mechanisms for mechanically loading the inner shroud against the outer shroud, such as springs, exhibit decreased effectiveness at high temperatures, and the springs themselves may creep over time, leading to insufficient loading pressure. Inner shrouds which are insufficiently biased toward the hot gas, for example due to insufficient loading pressure, have increased clearance between the bucket/blade tips and the inner shroud, which decreases the efficiency of the gas turbine.

BRIEF DESCRIPTION OF THE INVENTION

In an exemplary embodiment, a turbine shroud assembly includes an inner shroud having a surface adjacent to a hot gas path, an outer shroud, a damper block disposed between the inner shroud and the outer shroud, a first biasing apparatus, and a second biasing apparatus. The first biasing apparatus provides a first biasing force to the inner shroud, biasing the inner shroud a first deflection distance in a direction toward the hot gas path and away from the outer shroud. The second biasing apparatus provides a second biasing force to the damper block, biasing the damper block a second deflection distance in a direction toward the hot gas path and away from the outer shroud. The second deflection distance is greater than the first deflection distance, loading the damper block to the inner shroud.

In another exemplary embodiment, a turbine shroud assembly includes an inner shroud having a surface adjacent to a hot gas path, an outer shroud, a damper block disposed between the inner shroud and the outer shroud, a first springless biasing apparatus driven by a pressurized fluid, a second springless biasing apparatus driven by a pressurized fluid, and an adjustable deflection limiter. The first springless biasing apparatus provides a first biasing force to the inner shroud, biasing the inner shroud a first deflection distance in a direction toward the hot gas path and away from the outer shroud. The first springless biasing apparatus includes at least one bellows, at least one thrust piston, or a combination of at least one bellows and at least one thrust piston. The second springless biasing apparatus provides a second biasing force to the damper block, biasing the damper block a second deflection distance in a direction toward the hot gas path and away from the outer shroud. The second springless biasing apparatus includes at least one bellows, at least one thrust piston, or a combination of at least one bellows and at least one thrust piston. The adjustable deflection limiter is arranged and disposed such that the first deflection distance does not exceed a predetermined deflection. The predetermined deflection is alterable by adjustment of the deflection limiter. The second deflection distance is greater than the first deflection distance, loading the damper block to the inner shroud.

In another exemplary embodiment, a method for loading a turbine shroud assembly includes applying a first biasing force exerted by a first biasing apparatus to an inner shroud, biasing the inner shroud a first deflection distance in a direction toward a hot gas path and away from an outer shroud, and applying a second biasing force exerted by a second biasing apparatus to a damper block disposed between the inner shroud and the outer shroud, biasing the damper block a second deflection distance in a direction toward the hot gas path and away from the outer shroud. The second deflection distance is greater than the first deflection distance, loading the damper block to the inner shroud.

Other features and advantages of the present invention will be apparent from the following more detailed description, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided is a turbine shroud assembly. Embodiments of the present disclosure, for example, in comparison to concepts failing to include one or more of the features disclosed herein, reduce blade/bucket tip clearance, increase efficiency, increase durability, increase temperature tolerance, reduce the possibility of loss of load, reduce overall cost, eliminate the need for pressurizing the shroud, produce other advantages, or a combination thereof.

Figure 1:
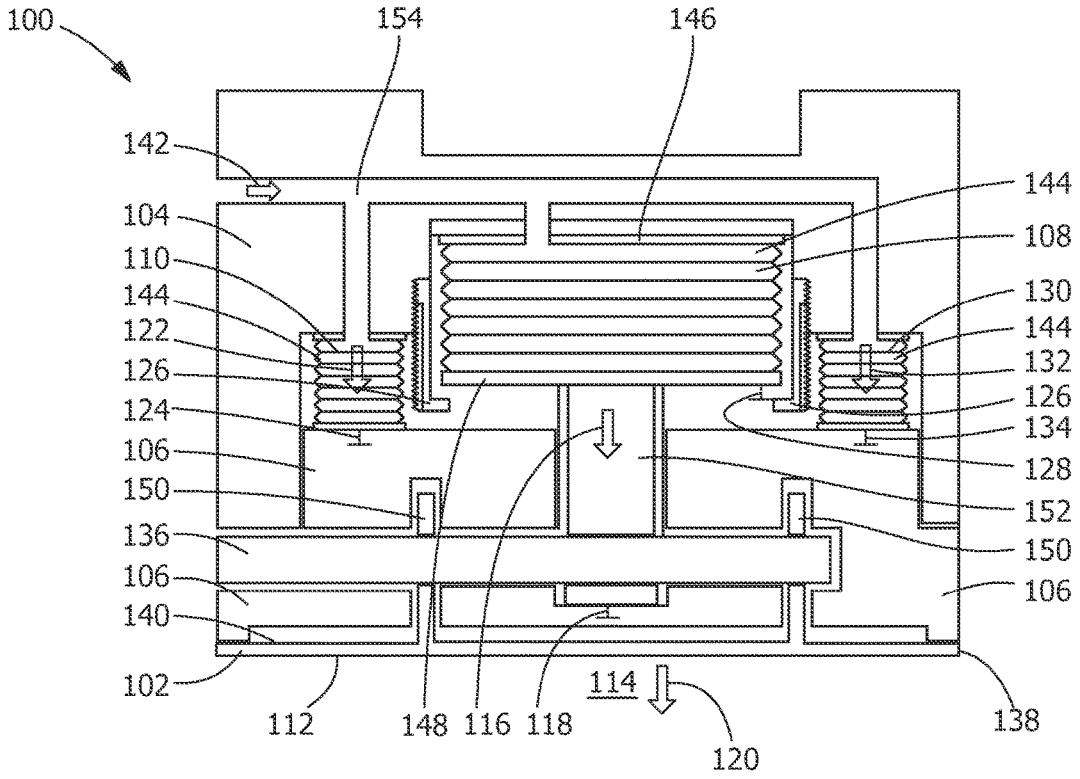
FIG. 1 is a sectioned view of turbine shroud assembly including at least one bellows, according to an embodiment of the disclosure.

Referring to FIG. 1, a turbine shroud assembly 100 includes an inner shroud 102, an outer shroud 104, a damper block 106, a first biasing apparatus 108 and a second biasing apparatus 110. The inner shroud 102 includes a surface 112 adjacent to a hot gas path 114. The damper block 106 is disposed between the inner shroud 102 and the outer shroud 104. The first biasing apparatus 108 provides a first biasing force 116 to the inner shroud 102. The first biasing force 116 biases the inner shroud 102 a first deflection distance 118 in a direction 120 toward the hot gas path 114 and away from the outer shroud 104. The second biasing apparatus 110 provides a second biasing force 122 to the damper block 106. The second biasing force 122 biases the damper block 106 a second deflection distance 124 in a direction 120 toward the hot gas path 114 and away from the outer shroud 104. The second deflection distance 124 is greater than the first deflection distance 118, loading the damper block 106 to the inner shroud 102.

In one embodiment, the first biasing apparatus 108 includes a deflection limiter 126. The deflection limiter 126 is arranged and disposed such that the first deflection distance 118 does not exceed a predetermined deflection 128. In a further embodiment, the deflection limiter 126 is adjustable. Adjusting the deflection limiter 126 alters the predetermined deflection 128. The deflection limiter 126 may threaded into the outer shroud 104 such that rotating the deflection limiter 126 will increase or decrease the predetermined deflection 128.

In one embodiment, the turbine shroud assembly 100 includes a third biasing apparatus 130. The third biasing apparatus 130 provides a third biasing force 132 to the damper block 106. The third biasing force 132 biases the damper block 106 a third deflection distance 134 in a direction 120 toward the hot gas path 114 and away from the outer shroud 104. The third deflection distance 134 is greater than the first deflection distance 118, loading the damper block 106 to the inner shroud 102. The turbine shroud assembly 100 may include any suitable number biasing apparatuses, including, but not limited to, more than three biasing apparatuses.

The first biasing apparatus 108 may be connected to the inner shroud 102 by any suitable attachment, including, but not limited to, a pin 136, a hook, a dovetail, a t-slot, or combinations thereof.

In one embodiment, the damper block 106 exerts a dampening pressure on the inner shroud 102 sufficient to dampen vibrations of the inner shroud 102 under operating conditions. The damper block 106 may be formed from any suitable material, including, but not limited to, a steel alloy, a stainless steel alloy, a nickel alloy, or a combination thereof. The damper block 106 may also include a thermal barrier coating which protects the damper block 106 from exposure to hot gas path 114 gasses. The damper block 106 may maintain alignment of the turbine shroud assembly 100 by moving only in the direction 120 due to the interface of the damper bloc 106 with the outer shroud 104. Without being bound by theory, it is believed that the vibrations of the inner shroud 102 are caused in part by the varying pressure field resulting from buckets/blades rotating in close proximity to the inner shroud 102. In another embodiment, contact between the inner shroud 102 and the damper block 106 reduces ingestion of hot gasses from the hot gas path 114 into the turbine shroud assembly 100.

In one embodiment, one of, two of, or all of the inner shroud 102, the outer shroud 104, and the damper block 106 includes a ceramic matrix composite, a metal, a monolithic material, or a combination thereof. As used herein, the term "ceramic matrix composite" includes, but is not limited to, carbon-fiber-reinforced carbon (C/C), carbon-fiber-reinforced silicon carbide (C/SiC), and silicon-carbide-fiber-reinforced silicon carbide (SiC/SiC).

In one embodiment, the surface 112 includes an environmental barrier coating (EBC) which protects the surface 112 from water vapor, heat, and other combustion gases. In another embodiment, the surface 112 includes a thermal barrier coating (TBC) which protects the surface 112 from heat. In yet another embodiment, at least one of the EBC and the TBC coats the exterior 138 of the inner shroud 102, including both the surface 112 as well as the distal surface 140.

In one embodiment, the turbine shroud assembly 100 includes a springless first biasing apparatus 108. In another embodiment, the turbine shroud assembly 100 includes a springless second biasing apparatus 110. As used herein, "springless" indicates that a biasing force, such as the first biasing force 116 applied to the inner shroud 102 or the second biasing force 122 applied to the damper block 106, is not generated by a spring. In certain embodiments, a springless first biasing apparatus 108 or a springless second biasing apparatus 110 may include a spring provided that any included spring does not generate a biasing force applied to the inner shroud 102 or the damper block 106.

In one embodiment, the first biasing apparatus 108 is driven by a pressurized fluid 142. In another embodiment, the second biasing apparatus 110 is driven by a pressurized fluid 142. The pressurized fluid 142 may be any fluid, including, but not limited to, air. Suitable sources for pressurized air include air from a gas turbine compressor. The first biasing force 116 and the second biasing force 122 are proportional to the pressure of the pressurized fluid 142 and the sectional area of the first biasing apparatus 108. In a further embodiment, the pressurized fluid 142 is sourced at a fixed location in the gas turbine compressor, and the first biasing force 116 and the second biasing force 122 vary with the pressure generated by the gas turbine compressor. In another embodiment, the first biasing force 116 and the second biasing force 122 may be controlled by adjusting the pressure of the pressurized fluid 142.

In one embodiment, the first biasing apparatus 108 includes at least one bellows 144 connecting to or contacting the inner shroud 102. In a further embodiment, the at least one bellows 144 includes a first end 146 attached to the outer shroud 104 and a second end 148 configured to expand toward the hot gas path 114 in response to an increased internal pressure within the at least one bellows 144. The expansion of the at least one bellows 144 exerts the first biasing force 116 on the inner shroud 102. The second end 148 of the at least one bellows 144 may be attached to at least one pin 136 which connects to at least one projection 150 of the inner shroud 102. In one embodiment, the second end 148 is attached to the at least one pin 136 by a stanchion 152.

In one embodiment, the second biasing apparatus 110 includes at least one bellows 144 connecting to or contacting the damper block 106. In a further embodiment, the at least one bellows 144 includes a first end 146 attached to the outer shroud 104 and a second end 148 configured to expand toward the hot gas path 114 in response to an increased internal pressure within the at least one bellows 144. The expansion of the at least one bellows 144 exerts the second biasing force 122 on the damper block 106. The second end 148 of the at least one bellows 144 may contact, directly or indirectly, the damper block 106.

In one embodiment, the at least one bellows 144 hermetically caps a pressurized fluidic supply line 154. As used herein, "hermetically caps" indicates that there is little or no leakage of pressurized fluid 142 from the region where the at least one bellows 144 joins with the pressurized fluidic supply line 154, and that there is also little or no leakage of pressurized fluid 142 from the at least one bellows 144.

Figure 2:
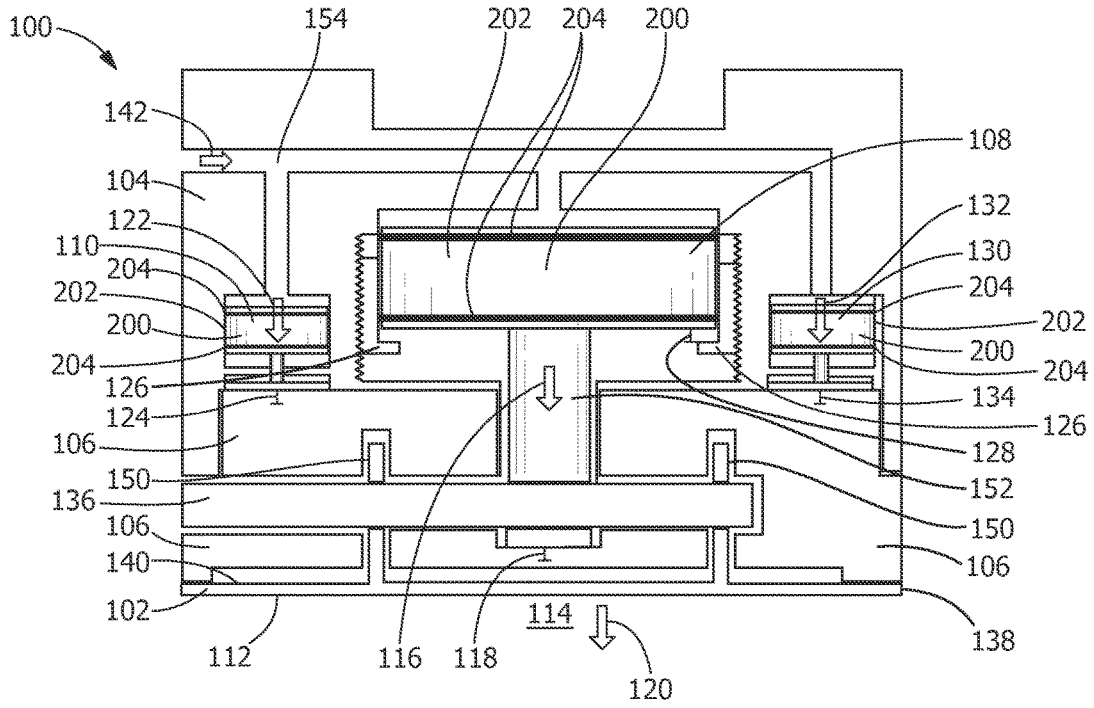
FIG. 2 is a sectioned view of turbine shroud assembly including at least one thrust piston, according to an embodiment of the disclosure.

Referring to FIG. 2, in one embodiment, the first biasing apparatus 108 includes at least one thrust piston 200 connecting to or contacting the inner shroud 102. The at least one thrust piston 200 may include a piston head 202 and at least one piston seal 204. In a further embodiment, the at least one thrust piston 200 is configured to urge the stanchion 152 in a direction 120 toward the hot gas path 114 in response to an increased pressure from the pressurized fluid 142. The movement of the at least one thrust piston 200 exerts the first biasing force 116 on the inner shroud 102. The piston head 202 may be attached to at least one pin 136 which connects to at least one projection 150 of the inner shroud 102. In one embodiment, the piston head 202 is attached to the at least one pin 136 by a stanchion 152.

In another embodiment, the second biasing apparatus 110 includes at least one thrust piston 200 connecting to or contacting the damper block 106. The at least one thrust piston 200 may include a piston head 202 and at least one piston seal 204. In a further embodiment, the at least one thrust piston 200 is configured to urge the stanchion 152 in a direction 120 toward the hot gas path 114 in response to an increased pressure from the pressurized fluid 142. The movement of the at least one thrust piston 200 exerts the second biasing force 122 on the damper block 106. The stanchion 152 may contact, directly or indirectly, the damper block 106.

Figure 3:
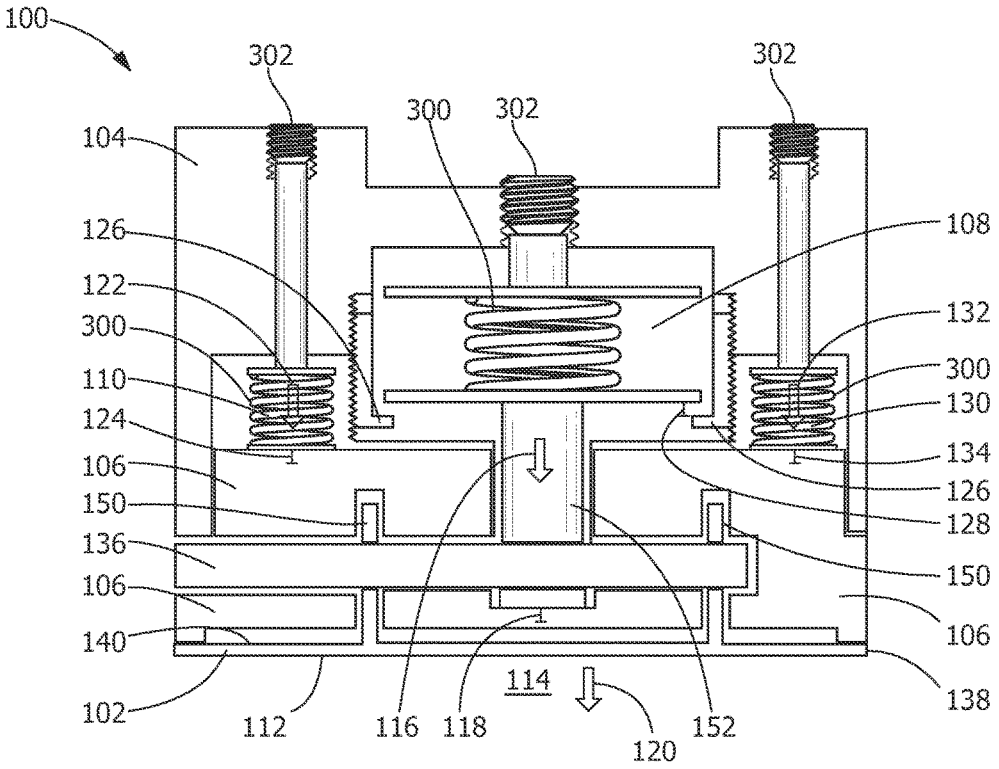
FIG. 3 is a sectioned view of turbine shroud assembly including at least one spring, according to an embodiment of the disclosure.

Referring to FIG. 3, in one embodiment, the first biasing apparatus 108 includes at least one spring 300 connecting to or contacting the inner shroud 102. The at least one spring 300 may include a pressure screw 302. The pressure screw 302 may be tightened to increase the compression of the at least one spring 300 or loosened to reduce the compression of the at least one spring 300. In a further embodiment, the at least one spring 300 is configured to urge the stanchion 152 in a direction 120 toward the hot gas path 114. The compression of the at least one spring 300 exerts the first biasing force 116 on the inner shroud 102. The at least one spring 300 may be attached to at least one pin 136 which connects to at least one projection 150 of the inner shroud 102. In one embodiment, the at least one spring 300 is attached to the at least one pin 136 by a stanchion 152.

In another embodiment, the second biasing apparatus 110 includes at least one spring 300 connecting to or contacting the damper block 106. The at least one spring 300 may include a pressure screw 302. The pressure screw 302 may be tightened to increase the compression of the at least one spring 300 or loosened to reduce the compression of the at least one spring 300. In a further embodiment, the at least one spring 300 is configured to urge the damper block 106 in a direction 120 toward the hot gas path 114. The compression of the spring 300 exerts the second biasing force 122 on the damper block 106. The at least one spring 300 may contact, directly or indirectly, the damper block 106.

Figure 4:
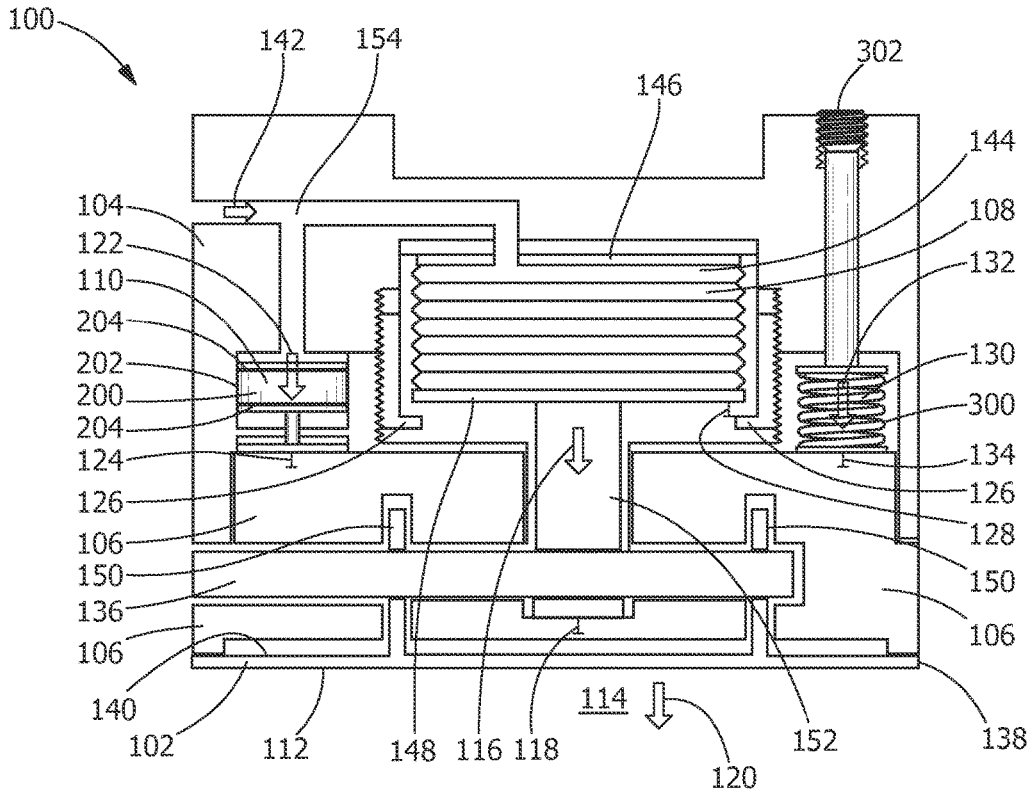
FIG. 4 is a sectioned view of turbine shroud assembly including at least two different biasing apparatuses, according to an embodiment of the disclosure.

Referring to FIG. 4, the turbine shroud assembly 100 may include combinations of bellows 144, thrust pistons 200 and springs 300, or a sub-set thereof. By way of example (shown), the first biasing apparatus 108 may include at least one bellows 144, the second biasing apparatus 110 may include at least one thrust piston 200, and the third biasing apparatus 130 may include at least one spring 300. These elements may be combined in any suitable combination, including in turbine shroud assemblies 100 having any number of biasing apparatuses.

Figure 5:
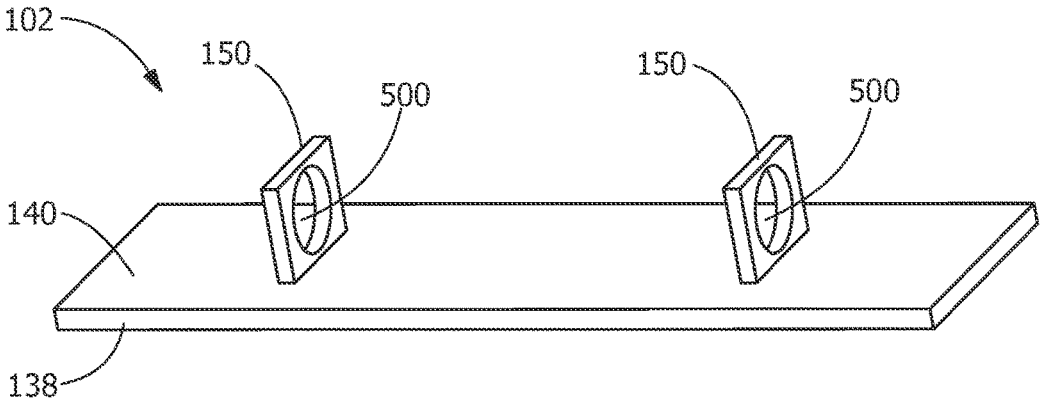
FIG. 5 is a perspective view of the inner shroud of FIGS. 1-4, according to an embodiment of the disclosure.

Referring to FIG. 5, in one embodiment the at least one projection 150 of the inner shroud 102 includes an insertion aperture 500. The insertion aperture 500 is arranged and disposed such that the at least one pin 136 may be inserted through the insertion aperture 500 to reversibly attach the inner shroud 102 to the first biasing apparatus 108.

Referring to FIGS. 1-4, a method for loading a turbine shroud assembly 100 includes applying a first biasing force 116 exerted by a first biasing apparatus 108 to the inner shroud 102, biasing the inner shroud 102 a first deflection distance 118 in a direction 120 toward a hot gas path 114 and away from an outer shroud 104, and applying a second biasing force 122 exerted by a second biasing apparatus 110 to a damper block 106 disposed between the inner shroud 102 and the outer shroud 104, biasing the damper block 106 a second deflection distance 124 in a direction 120 toward the hot gas path 114 and away from the outer shroud 104. The second deflection distance 124 is greater than the first deflection distance 118, loading the damper block 106 to the inner shroud 102. In one embodiment, the first biasing apparatus 108 may be any suitable mechanism, including, but not limited to, at least one spring 300, at least one bellows 144, at least one thrust piston 200, or a combination thereof. In another embodiment, the second biasing apparatus 110 may be any suitable mechanism, including, but not limited to, at least one spring 300, at least one bellows 144, at least one thrust piston 200, or a combination thereof.

In one embodiment, loading a turbine shroud assembly 100 by biasing the inner shroud 102 in a direction 120 toward the hot gas path 114 and away from the outer shroud 104, and biasing the damper block 106 in a direction 120 toward the hot gas path 114 and away from the outer shroud 104, wherein the second deflection distance 124 is greater than the first deflection distance 118, loading the damper block 106 to the inner shroud 102, reduces damaging vibrations in the inner shroud 102, in comparison to a turbine shroud assembly 100 lacking the damper block 106. Without being bound by theory, it is believed that such damaging vibrations may be exacerbated in a turbine shroud assembly 100 in which the space between the inner shroud 102 and the outer shroud 104 is not pressurized by a fluid, such as, by way of example only, pressurized fluid 142.

Each turbine shroud assembly 100 in a turbine may be individually adjusted to account for out of roundness of a turbine stator assembly as well as individualized blade/bucket tip clearance, optimizing turbine efficiency. Additionally, the first biasing apparatus 108 and the third biasing apparatus 130 may be individually adjusted within a turbine shroud assembly 100 to adjust the first biasing force 116 and the third biasing force 132 in order to optimize loading under conditions where the pressure of the hot gas path 114 varies across the surface 112 of the inner shroud 102. Without being bound by theory, it is believed that such variations in the hot gas path 114 varies across the surface 112 of the inner shroud 102 may be caused by the operation of blades/buckets in close proximity to the inner shroud 102, which may cause higher pressure at a leading edge of an inner shroud 102 in comparison to a trailing edge. Adjustment of the first biasing apparatus 108 and the third biasing apparatus 130 may also account for natural frequencies of the inner shroud 102.

While the invention has been described with reference to one or more embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A turbine shroud assembly, comprising:

an inner shroud having a surface adjacent to a hot gas path;

an outer shroud;

a damper block disposed between the inner shroud and the outer shroud;

a first biasing apparatus providing a first biasing force to the inner shroud, biasing the inner shroud a first deflection distance in a direction toward the hot gas path and away from the outer shroud; and a second biasing apparatus providing a second biasing force to the damper block, biasing the damper block a second deflection distance in the direction toward the hot gas path and away from the outer shroud, wherein the second deflection distance is greater than the first deflection distance, loading the damper block to the inner shroud.

2. The turbine shroud assembly of claim 1, wherein the first biasing apparatus includes at least one spring, the spring connecting to or contacting the inner shroud and configured to exert the first biasing force on the inner shroud.

3. The turbine shroud assembly of claim 1, wherein the first biasing apparatus is a springless biasing apparatus.

4. The turbine shroud assembly of claim 3, wherein the biasing apparatus is driven by a pressurized fluid.

5. The turbine shroud assembly of claim 1, wherein the first biasing apparatus includes at least one bellows connecting to or contacting the inner shroud, the at least one bellows configured to expand toward the hot gas path in response to an increased internal pressure within the at least one bellows and to exert the first biasing force on the inner shroud.

6. The turbine shroud assembly of claim 5, wherein the at least one bellows hermetically caps a pressurized fluidic supply line.

7. The turbine shroud assembly of claim 1, wherein the first biasing apparatus includes at least one thrust piston connected to or contacting the inner shroud and configured to exert the first biasing force on the inner shroud.

8. The turbine shroud assembly of claim 1, wherein the first biasing apparatus includes a deflection limiter, the deflection limiter arranged and disposed such that the first deflection distance does not exceed a predetermined deflection.

9. The turbine shroud assembly of claim 8, wherein the deflection limiter is adjustable, altering the predetermined deflection.

10. The turbine shroud assembly of claim 1, wherein the second biasing apparatus includes at least one spring, the spring connecting to or contacting the damper block and configured to exert the second biasing force on the damper block.

11. The turbine shroud assembly of claim 1, wherein the second biasing apparatus is a springless biasing apparatus.

12. The turbine shroud assembly of claim 11, wherein the second biasing apparatus is driven by a pressurized fluid.

13. The turbine shroud assembly of claim 1, wherein the second biasing apparatus includes at least one bellows connecting to or contacting the damper block, the at least one bellows configured to expand toward the hot gas path in response to an increased internal pressure within the at least one bellows and to exert the second biasing force on the damper block.

14. The turbine shroud assembly of claim 13, wherein the at least one bellows hermetically caps a pressurized fluidic supply line.

15. The turbine shroud assembly of claim 1, wherein the second biasing apparatus includes at least one thrust piston connected to or contacting the damper block and configured to exert the second biasing force on the damper block.

16. The turbine shroud assembly of claim 1, wherein the damper block includes a thermal barrier coating, wherein the turbine shroud assembly further includes a third biasing apparatus providing a third biasing force to the damper block, biasing the damper block a third deflection distance in the direction toward the hot gas path and away from the outer shroud, and wherein the third deflection distance is greater than the first deflection distance, loading the damper block to the inner shroud.

17. A turbine shroud assembly, comprising:

an inner shroud having a surface adjacent to a hot gas path;

an outer shroud;

a damper block disposed between the inner shroud and the outer shroud;

a first springless biasing apparatus driven by a pressurized fluid, providing a first biasing force to the inner shroud, biasing the inner shroud a first deflection distance in a direction toward the hot gas path and away from the outer shroud, the first springless biasing apparatus including at least one bellows, at least one thrust piston, or a combination of at least one bellows and at least one thrust piston;

a second springless biasing apparatus driven by the pressurized fluid, providing a second biasing force to the damper block, biasing the damper block a second deflection distance in the direction toward the hot gas path and away from the outer shroud, the second springless biasing apparatus including at least one bellows, at least one thrust piston, or a combination of at least one bellows and at least one thrust piston; and an adjustable deflection limiter, the deflection limiter arranged and disposed such that the first deflection distance does not exceed a predetermined deflection, the predetermined deflection alterable by adjustment of the deflection limiter, wherein the second deflection distance is greater than the first deflection distance, loading the damper block to the inner shroud.

18. The turbine shroud assembly of claim 17, wherein the damper block includes a thermal barrier coating, wherein the turbine shroud assembly further includes a third springless biasing apparatus driven by the pressurized fluid, providing a third biasing force to the damper block, biasing the damper block a third deflection distance in the direction toward the hot gas path and away from the outer shroud, the third springless biasing apparatus including at least one bellows, at least one thrust piston, or a combination of at least one bellows and at least one thrust piston, and wherein the third deflection distance is greater than the first deflection distance, loading the damper block to the inner shroud.

19. A turbine shroud assembly, comprising:

an inner shroud having a surface adjacent to a hot gas path;

an outer shroud;

a damper block disposed between the inner shroud and the outer shroud;

a first biasing apparatus providing a first biasing force to the inner shroud, biasing the inner shroud a first deflection distance in a direction toward the hot gas path and away from the outer shroud;

a second biasing apparatus providing a second biasing force to the damper block, biasing the damper block a second deflection distance in the direction toward the hot gas path and away from the outer shroud; and a third biasing apparatus providing a third biasing force to the damper block, biasing the damper block a third deflection distance in the direction toward the hot gas path and away from the outer shroud, wherein the second deflection distance is greater than the first deflection distance and the third deflection distance is greater than the first deflection distance, loading the damper block to the inner shroud.

20. The turbine shroud assembly of claim 19, wherein:

the first biasing apparatus is a first springless biasing apparatus driven by a pressurized fluid, the first springless biasing apparatus including at least one bellows, at least one thrust piston, or a combination of at least one bellows and at least one thrust piston;

the second biasing apparatus is a second springless biasing apparatus driven by a pressurized fluid, the second springless biasing apparatus including at least one bellows, at least one thrust piston, or a combination of at least one bellows and at least one thrust piston;

the third biasing apparatus is a third springless biasing apparatus driven by a pressurized fluid, the third springless biasing apparatus including at least one bellows, at least one thrust piston, or a combination of at least one bellows and at least one thrust piston; and the turbine should assembly further includes an adjustable deflection limiter, the deflection limiter arranged and disposed such that the first deflection distance does not exceed a predetermined deflection, the predetermined deflection alterable by adjustment of the deflection limiter.

21. A turbine shroud assembly, comprising:

an inner shroud having a surface adjacent to a hot gas path;

an outer shroud;

a damper block disposed between the inner shroud and the outer shroud, the damper block including a thermal barrier coating;

a first biasing apparatus providing a first biasing force to the inner shroud, biasing the inner shroud a first deflection distance in a direction toward the hot gas path and away from the outer shroud; and a second biasing apparatus providing a second biasing force to the damper block, biasing the damper block a second deflection distance in the direction toward the hot gas path and away from the outer shroud, wherein the second deflection distance is greater than the first deflection distance, loading the damper block to the inner shroud.

22. The turbine shroud assembly of claim 21, wherein:

the first biasing apparatus is a first springless biasing apparatus driven by a pressurized fluid, the first springless biasing apparatus including at least one bellows, at least one thrust piston, or a combination of at least one bellows and at least one thrust piston;

the second biasing apparatus is a second springless biasing apparatus driven by a pressurized fluid, the second springless biasing apparatus including at least one bellows, at least one thrust piston, or a combination of at least one bellows and at least one thrust piston; and the turbine should assembly further includes an adjustable deflection limiter, the deflection limiter arranged and disposed such that the first deflection distance does not exceed a predetermined deflection, the predetermined deflection alterable by adjustment of the deflection limiter.

* * * * *